United States Patent [19]

Anderson

[11] 4,128,962

[45] Dec. 12, 1978

[54] BUBBLE DISCHARGING DEVICE

[76] Inventor: Paul R. Anderson, 23701 Surf Cove, Laguna Niguel, Calif. 92677

[21] Appl. No.: 723,806

[22] Filed: Sep. 16, 1976

[51] Int. Cl.[2] ..... A63H 33/28

[52] U.S. Cl. ..... 46/7

[58] Field of Search ..... 46/6–8

[56] References Cited

U.S. PATENT DOCUMENTS

| | | | |
|---|---|---|---|
| 2,430,999 | 11/1947 | Skinner | 46/7 |
| 2,741,068 | 4/1956 | Hollis | 46/7 |
| 3,246,418 | 4/1966 | Anderson et al. | 46/8 |
| 3,295,248 | 1/1967 | Knerr et al. | 46/6 |
| 3,958,362 | 5/1976 | Kessler | 46/7 |

*Primary Examiner*—Louis G. Mancene
*Assistant Examiner*—Robert F. Cutting
*Attorney, Agent, or Firm*—William I. Beach

[57] ABSTRACT

A device for discharging a group of bubbles stuck together is adapted to be operated when held in hand and when mounted on a vehicle such as a bicycle. The device includes a multiple ring structure mounted in the bore of a tube having an air receiving entrance and an exit end. A reservoir which has multiple orifices in its bottom wall is also mounted in the upper wall of the tube. Bubble forming fluid stored in the reservoir is metered through the orifices and directed downwardly to form a film across the openings in the ring structure. In response to movement of air through the tube an expanding curtain of film is formed and released from the ring structure openings and discharged out of the exit end of the tube in an assortment of bubbles. A sump is demountably secured to the bottom wall of the tube for collecting drops of fluid not consumed in forming bubbles.

7 Claims, 4 Drawing Figures

BUBBLE DISCHARGING DEVICE

BACKGROUND OF THE INVENTION

1. Field of the Invention

The present invention relates to bubble forming devices and more particularly to an improved device for making multiformed bubbles.

2. Description of the Prior Art

A simple bubble making device is a ring connected to the end of a stem which is dipped into a bottle of soapy solution. Withdrawing the ring so that a film is spread across the opening the operator blows on the film until a bubble is formed and released into the air. Other types have been developed wherein a ring or some form of an aperture is connected directly to a bottle or container from which it is supplied with soapy fluid. More advanced devices tend to incorporate mechanical elements for the most part that require an operator to activate. These devices work reasonably well providing there is coordinating action between the operator and device to make it function effectively. There are problems connected with such devices having to do with proper control of the means for metering soapy fluids, priming, dripping and drainage. Metering of the fluid is concerned with the number and size of orifices and, of course, exact location so as to direct beads of fluid on the aperture.

Priming involves the means for spreading a film of fluid across the aperture for formation of a bubble. Dripping is generally present in such devices because it is difficult to control the rate of the metering process with the frequency of release of bubbles from the aperture. As a result some drainage occurs and to avoid loss of fluid and messy handling procedures a closure type tube is a tank for containing a quantity of soapy liquid. A hollow stem extends from the tank to dispense a flow of the liquid to the hollow chamber in the ring. The rearward face of the ring is concave and includes a number of outlet orifices which open rearwardly through the concave face of the ring. The soapy liquid flowing outwardly through the orifices flows downwardly within the concave channel to fill the channel completely. The device is then activated manually to draw some of the liquid within the concave face inwardly within the ring to form a film over the opening. Then in order to prime the ring a movable pad controlled by the operator is brought to bear against the concave channel and the liquid wets the surface of the pad. When the pad is withdrawn it will draw some of the liquid away to initiate the formation of a film over the opening. Thus, the liquid will continue to flow and the film will be regenerated quite rapidly which permits bubbles to be formed.

The above described procedure for priming the ring and formation of bubbles is not consistent with the aerodynamics of airflow. In that connection it is purported that due to the laminar flow of air past the ring the static pressure will drop which will be effective in drawing liquid into the rearward concave channel and the formation of bubbles will continue as long as airflow and supply of liquid continues. Obviously, this statement must be in error because the flow of air through the opening and over the peripheral edge of the ring will tend instead to create a vortex adjacent to the rearward face of the concave channel of the ring and produce a back pressure thereon. Therefore, in view of this it is doubtful that the fluid will flow rapidly into the channel. Further, if the pad is pressed against the concave channel and it is full of fluid, as stated, the sudden withdrawal of the pad will literally spill the channel empty of fluid regardless of whether or not the air is in movement. Therefore, there is no provision for drainage and the fluid will run out of the tapered tube.

The Wakeem device, like Lerman's device, is manually primed in order to form a film of soapy liquid over the bubble forming aperture. This device includes a bottle for holding a quantity of soapy liquid. An elongated tube extends through the top of the bottle to reach the bottom surface of the liquid. The other end is connected to a compressible bulb. A shorter tube also extends out of the top of the bottle having its open lower end positioned above the top of the liquid. Accordingly, when this device is mounted on a bicycle the operator squeezes the bulb which forces air through the elongated tube to the bottom of the bottle. Presumably, the air pressure in the liquid causes a bubble to form on the top surface of the liquid whence it is forced upwardly to the bottom opening of the shorter tube and outwardly of the tube.

Obviously, the Wakeem device requires continuous operator control to prime the shorter tube. Further, it is questionable that the formation of bubbles will last very long because the space between the top of the liquid and the bottom opening of the shorter tube must be critical. For example, as the supply of liquid is used up and the level drops in the bottle it is doubtful that sufficient air pressure can be generated in the elongated tube to lift a bubble of film from the surface of the liquid to the bottom opening of the shorter tube.

In view of the above, it is seen that the Lerman and Wakeem devices are partly or wholly dependent on the manual control of an operator. These and other devices now on the market contend with some or most of the problems related above. Also, by virtue of their construction these devices are primarily limited to the formation of singular or simple annular shaped bubbles of relatively small sizes.

Therefore, it is the object of the present invention to provide a bubble discharging device that will solve the aforementioned problems. It is assembled in one piece, compact and a wholly self-operating unit can be manufactured inexpensively with simple and unique means for producing an assortment of bubbles including ones stuck together in clusters, some large in size as a basketball.

SUMMARY OF THE INVENTION

In carrying out the principles of the present invention in accordance with a preferred embodiment thereof, a bubble discharging device has a tube having an entrance, an exit end and a bore for receiving a stream of air through the bore. Connected to the bore of the tube a reservoir is arranged to contain a supply of bubble forming liquid. Included in the bore of the tube a structure having plural openings therethrough is supported downwardly from the reservoir. The structure placed with the openings normal to the air-stream is adapted to receive a film of liquid across the opposite sides of the openings. There are orifice means incorporated in the reservoir which are arranged to direct flowing beads of liquid on the opposite sides of the openings. The structure is constructed so as to form a bubble from the film stretched across the openings and release a succession of bubbles into the air-stream when the air-stream is passed through the openings and discharged from the exit end of the tube. A sump connected to the lower wall of the tube has a port extending through the wall adjacent the exit end of the tube for collecting drips of the liquid not consumed in forming bubbles.

DETAILED DESCRIPTION

Figure 1:
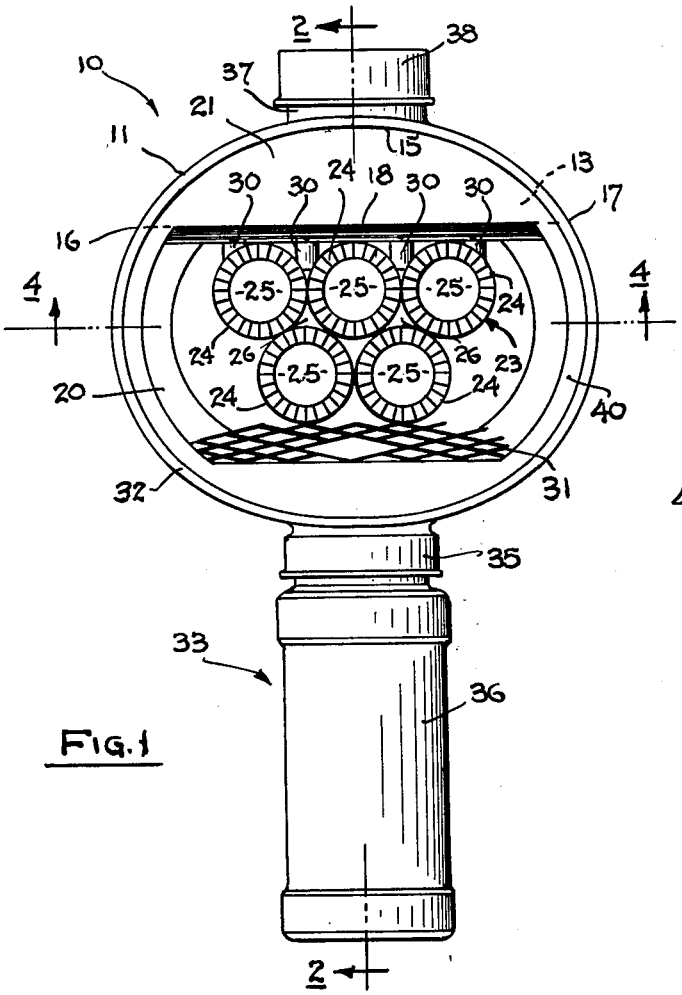
FIG. 1 is a rear elevation view of a device representing the present invention.
Figure 2:
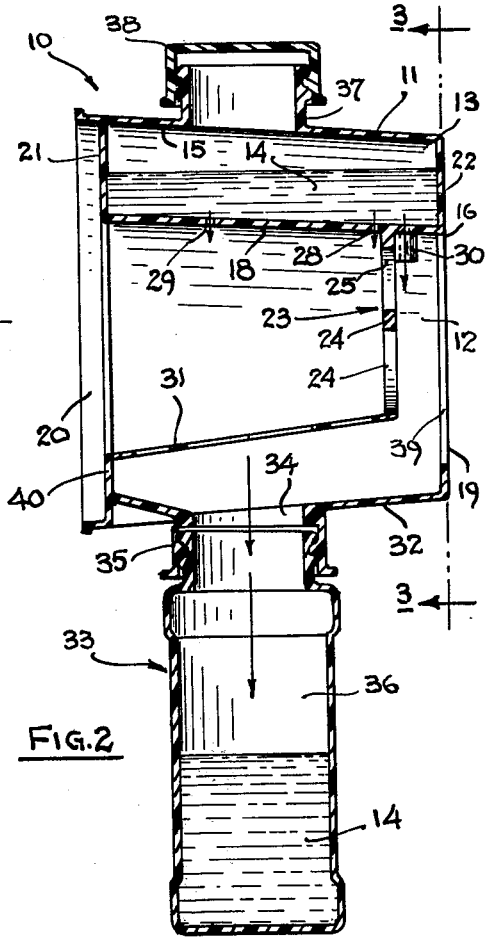
FIG. 2 is a cross-sectional view of the present invention taken along line 2—2 of FIG. 1.

Referring to FIG. 1 and 2 the device 10 disclosed consists of a tubular housing 11 having a central bore 12. Inside of bore 12 is a reservoir 13 for holding a supply of soapy liquid 14 processed in device 10 for making an assortment of bubbles, some stuck together in a cluster. Reservoir 13 is constructed with upper wall 15 of tube 11 forming an arc connected at the extremities 16 and 17 to flat bottom wall 18. The bottom wall 18 extends from a point adjacent to the entrance 19 to adjacent the exit end 20. Opposite end walls 21 and 22 complete the closure of reservoir 13.

Supported downwardly from bottom wall 18 is a ring structure 23 comprising a triangular stack of at least five rings 24 arranged in a vertical plane having openings 25 normal to bore 12 of tube 11. The five rings are connected together so that their peripheral edges form three triangular spaces or openings 26 at the juncture of the five rings.

Figure 4:
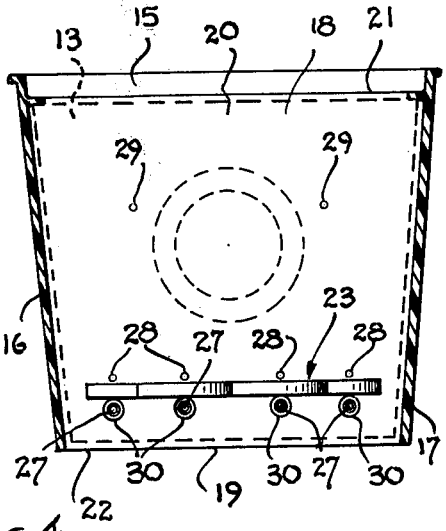
FIG. 4 is a top plan view of the present invention taken along line 4—4 of FIG. 1.

Incorporated in the bottom wall 18 of reservoir 13 are a plurality of outlet orifices for metering a controlled flow of soapy liquid 14 stored in reservoir 13 for the formation of bubbles. Accordingly, referring to FIG. 4 there can be seen a first row of four orifices 27 disposed transversely across the bottom reservoir 13 adjacent to entrance 19 side of ring structure 23. Orifices 27 are spaced equidistant apart with respect to each other and have the opposite outer orifices spaced approximately one-half of the space between two adjacent orifices to the extremities 16 and 17 of the arc of upper wall 15. Immediately behind and adjacent to ring structure 23 is a second row of four orifices 28 spaced in the same pattern exhibited by the first row of orifices 27. Forward of the second row of orifices 28 approximately three-quarters of the distance from entrance 19 to exit end 20 of tube 11 is a third transversely disposed row of two orifices 29 spaced apart so that each orifice is located approximately one-fourth of the transverse distance across bottom wall 18 to the extremities 16 and 17 of the arc of upper wall 15.

Extending downwardly from reservoir 13 also are four short hollow stems 30 adapted to enclose the first row of four orifices 27 and direct a flow of liquid 14 downwardly to form a film across openings 25 and 26. The manner in which groups of bubbles stuck together are developed from openings 25 and 26 will be discussed later.

Figure 3:
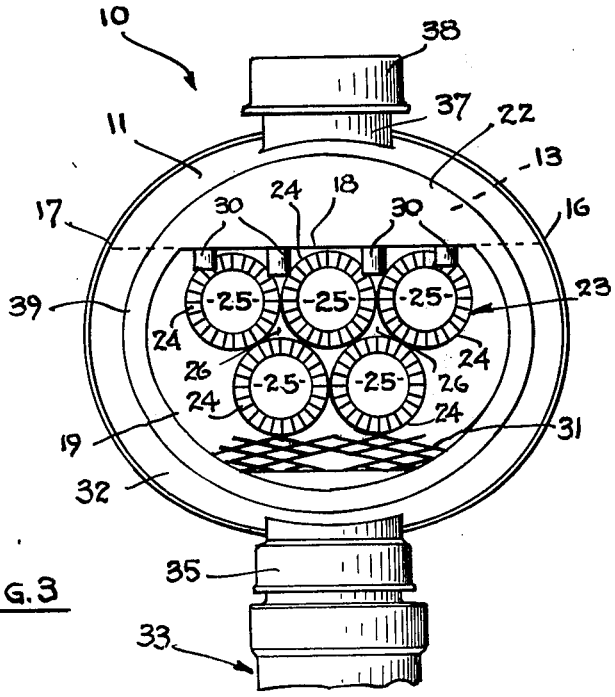
FIG. 3 is a front partial view of the present invention taken along line 3—3 of FIG. 2.

To complement the ring structure 23 in the formation of bubbles a lattice type screen 31 is positioned below reservoir 13 and adjacent to the lower wall 32 of tube 11. Screen 31 is secured to the opposite sides of lower wall 32 and extends from adjacent exit end 20 to adjacent the entrance 19 side of ring structure 23 as shown in FIG. 2 and 3. The purpose and primary function of screen 31 will be covered when the operation of the present invention is discussed.

In light of the above, it is important to point out that bubbles are formed from a film of soapy-like liquid stretched across the framework of an aperture and air pressure is exerted on the aperture to expand and close the film in a conventional bubble. Therefore, unless exact control means are present to utilize all of the liquid to make bubbles there is bound to be a waste of run-off of the liquid. Since a metering system devised to eliminate run-off would be complicated and very expensive for conventional bubble making devices such devices have to contend with messy and disagreeable run-off liquid.

In that connection, the present invention provides a sump 23 for collecting the run-off of liquid 14 not consumed in making bubbles. The sum includes a port 34 extending through lower wall 32 and is located adjacent the exit end 20 of tube 11. An internally threaded sleeve 35 is mounted around port 34 on the exterior surface of tube 11. Threadably engaged in sleeve 35 is the open end of an elongated cylindrical container 36 arranged to collect liquid 14 which may drain off of bottom wall 18 of reservoir 13, ring structure 23 and screen 31 during the period when air pressure is not moving through tube 11. While the slope of lower wall 32 and sump 33 are quite adequate to collect run-off of liquid when the median axis of tube 11 is supported in substantially a horizontal position an excessive tilting of the tube downwardly beyond the horizontal may cause liquid to spill out of entrance 19 or exit end 20. Accordingly, an internally extending annular rim 39 and 40 is secured adjacent to entrance 19 and exit end 20 respectively to contain liquid 14 within the tube so as to drain into sump 33. As can be clearly seen in FIG. 2 the container 36 can be threadably removed and emptied. Further, liquid 14 in container 36 may be poured into the reservoir 13 through filler opening 37 by removing filler cap 38. In operating the present invention large groups of bubbles sticking together can be discharged from the exit end 20 of tube 11 by holding entrance end 19 close to mouth and blowing air upon the soapy film coated ring structure 23 therein. Similar clusters of bubbles can be produced when the present invention is mounted on a moving bicycle. For example, with cylindrical container 36 supported in the clevis end of an arm secured to a bicycle and tube 11 positioned with entrance end 19 facing forwardly, the stream of air passing therethrough on film coated ring structure 23 discharges an assortment of bubbles rearwardly from exit end 20.

In either case, liquid 14 contained in reservoir 13 is metered by gravitational flow through orifices 27, 28 and 29. The orifices 27 and 28 which are located on opposite sides and adjacent to ring stucture 23 spread fine beads of liquid 14 over the connected rings to form a double layer of film over ring openings 25 and triangular openings 26. Obviously, if there is no movement of air while metering of liquid 14 is in process the liquid will run off of the ring structure 23, reservoir 13 and screen 31 to drain through port 34 into container 36. However, if air is forced through bore 12 a stream of large bubbles, some as large as a basketball, will be discharged from the exit end 20 of tube 11. The achievement of large bubbles of what generally appears to be a multiple arrangement of different shaped bubbles combined into a single globular mass is due to the unique arrangement and design of the aforementioned ring structure, metering system and lattice screen. As previously stated, a double layer of film is spread over opposite sides of ring openings 25 and triangular openings 26. In conjunction therewith, air pressure bearing on the entrance 19 side of ring structure 23 initially extends or expands the film over the three triangular openings 26 to be followed immediately by expanding film from ring openings 25. Although applicant is not certain how the expanding film from openings 25 and 26 co-act together with the bottom wall of reservoir 13 and lattice screen 31 it appears that the front surface of the expanding film has different size peaks thereon and when the foremost peak is being discharged and formed into a bubble the next peak attaches to it and yet another until the combined weight of the mass or the change in velocity of the air passing through tube 11 separates the cluster of bubbles from exit end 20. The expanding film from said openings expand further until it reaches bottom wall 18 of reservoir 13 and screen 31. Beads of liquid 14 emerging from the third row of orifices 29 spread out and cling largely to the bottom wall 18 of the reservoir 13 due to the passage of air through tube 11 until it is reached by the expanding film mass whereupon a curtain wall of moving film is formed from top to bottom of tube 11. Thereafter, when the first bubble is discharged from the exit end 20 the curtain wall of film snaps back into tube 11 to complete the next or series of bubbles discharged from the tube.

From the description and illustration of the present invention it is obvious that it provides many important advantages which can be used effectively and efficiently to manufacture bubbles.

The foregoing description is to be clearly understood to be given by way of illustration and example only, the spirit and scope of the present invention being limited by the appended claims.

I claim:

1. A bubble discharging device adapted to be mounted on a vehicle, which comprises:

a tube having an entrance, an exit end and a bore for receiving a stream of air therethrough, a receptacle mounted in the bore of the tube for storing a quantity of soapy bubble forming liquid, the receptacle forming an enclosed chamber having a cross-section defined by a segment of said tube comprising an upper inner wall, a chord-like flat bottom wall connecting the extremities of the arc-like upper wall and opposed verticle end walls connecting the segment with the arc and chord of said tube, said receptacle further including a liquid refill opening in said upper wall to refill said reservoir with said liquid, a multiple ring structure having plural openings therethrough supported downwardly from said reservoir, the structure being stationed with the openings placed normal to the direction of the air-stream and adapted to be wetted by a film of the liquid across the opposite sides of said plural openings, orifice means incorporated in said receptacle arranged to direct flowing beads of said liquid on both sides of said openings, said structure being adapted to form a bubble from the film stretched across said openings and release a succession of bubbles into said air-stream when said air-stream is passed through said openings and subsequently discharged from the exit end of said tube, and a sump connected to a lower wall of said tube having a port extending through the wall adjacent said exit end, the sum being adapted to collect the drips of said liquid not consumed in forming said bubbles, the port being reinforced by an internally threaded sleeve surrounding said port and said sump and further including an elongated cylindrical enclosure having the open end of the enclosure threadedly engaged in the sleeve.

2. The device as recited in claim 1, wherein:

said multiple ring structure comprises a triangular facade of at least five rings connected with their peripheral edges together in a three and two ring vertical plane to form three triangular openings at the juncture of five rings, said structure being mounted with the apex of said two rings depending downwardly from said receptacle.

3. The device as recited in claim 2, wherein:

said ring structure is positioned adjacent said entrance having an upstream said facing said entrance and an opposite downstream side facing said exit end normal to the air-stream directed through said tube.

4. The device as recited in claim 3, wherein:

the orifice means comprise at least four exit holes in registry with said ring structure, said holes arranged to direct beads of said liquid downwardly on the upstream side of said structure and at least four exit holes similarly placed so as to direct beads of said liquid downwardly on the downstream side of said structure and further including at least two transversely spaced apart exit holes positioned intermediate said structure and said exit end of said tube, the holes adapted to form a film of said liquid over said bottom wall of said receptacle when said stream of air is passed through said tube.

5. The device as recited in claim 4, further including:

a thin wall hollow stem enclosing said exit holes on the upstream side of said ring structure, the stem depending downwardly from said receptacle to provide an open end adjacent to said rings, said stem having the inner wall in registry with said exit holes so that beads of said liquid drains downwardly on said wall and thence over the openings on said upstream side of said structure.

6. The device as recited in claim 5, further including:

a film forming lattice-like screen extending axially and transversely to intersect the sides of said tube, the screen being spaced below said receptacle so that a continuous bridge of said film forming bubbles is formed therebetween when said air-stream is passed through said tube.

7. The device as recited in claim 6, wherein:

the cylindrical enclosure is threadably engaged in the sleeve secured to the said lower wall of said tube and adapted to be removed to empty said liquid collected in said enclosure.

* * * * *